United States Patent [19]

Frankenfield

[11] 4,228,786

[45] Oct. 21, 1980

[54] FLOW DIRECTOR

[75] Inventor: Fred I. Frankenfield, Noblesville, Ind.

[73] Assignee: Hedback Corp., Indianapolis, Ind.

[21] Appl. No.: 9,411

[22] Filed: Feb. 5, 1979

[51] Int. Cl.[3] ..... F24D 5/04

[52] U.S. Cl. ..... 126/427; 165/18; 165/104 S; 126/400; 137/625.42

[58] Field of Search ..... 237/44; 126/400; 165/18, 104 S; 137/625.42, 625.43, 625.46; 98/33 R; 251/304

[56] References Cited

U.S. PATENT DOCUMENTS

| | | | |
|---|---|---|---|
| 544,799 | 8/1895 | Swindell | 137/625.43 X |
| 2,347,936 | 5/1944 | Crewson | 98/33 R |
| 2,680,565 | 7/1954 | Lof | 165/18 X |

FOREIGN PATENT DOCUMENTS

| | | | |
|---|---|---|---|
| 1024299 | 2/1958 | Fed. Rep. of Germany | 137/625.43 |
| 1600959 | 6/1970 | Fed. Rep. of Germany | 137/625.43 |

*Primary Examiner*—Albert J. Makay
*Assistant Examiner*—Henry Bennett
*Attorney, Agent, or Firm*—Woodard, Weikart, Emhardt & Naughton

[57] ABSTRACT

A flow director including a diverting box defining four openings and having four baffles mounted therein. A damper is rotatable within the diverting box to provide for flow in one position between the first and fourth openings and between the second and third openings. In a second position of the damper flow is permitted only between the second and third openings. The combination of the flow director and an air treating means provides for desired flow paths of the air for heating and/or cooling purposes.

2 Claims, 4 Drawing Figures

FLOW DIRECTOR

BACKGROUND OF THE INVENTION

1. Field of the Invention

The present invention relates to devices for controlling the flow of materials, and more particularly to devices for providing alternate flow patterns for air systems such as forced air heating and cooling systems.

2. Description of the Prior Art

A variety of flow direction devices are known in the prior art. Such devices range from simple damper mechanisms to more complicated apparatus for providing alternate flow paths. Such devices typically include an internally mounted damper which is rotatable or pivotable about an axis.

In certain applications it is desirable that the flow control apparatus provide for alternate, coordinated flow paths. Systems for such applications are known in the prior art. In U.S. Pat. No. 2,225,071, issued to Meyerhoefer on Dec. 17, 1940, there is disclosed a heat transfer device including a valve for directing the flow of air therethrough. The Meyerhoefer patent discloses a valve utilizing a V-shaped damper which in one position only permits flow from a first passageway to a second passageway. In a second position, the damper permits flow to be split from the first passageway to each of a second and third passageway. In U.S. Pat. No. 1,215,185, issued to Petry on Feb. 6, 1917, there is disclosed a muffler accessory which includes a valve for controlling the flow path of gases passing therethrough. The device includes a brached passageway and a member mounted to pivot at the center of the branch. The member is positionable in front of either of the branches to block flow to that passageway and to force the flow to move through the other passageway.

A controlling device for drying apparatus is disclosed in U.S. Pat. No. 2,347,936, issued to Crewson on May 2, 1944. The Crewson device includes a cylindrical chamber defining circumferentially-spaced openings connectd to a fresh air inlet, an outlet to a heating chamber, an inlet from a drying chamber, and a spent air outlet, consecutively. Selected ones of the openings are of varying sizes to provide for "dwell" areas between openings. A valve is mounted within the cylindrical chamber and is rotatable about a central axis to control flow between the various inlets and outlets. A baffle extends inwardly to the axis of the valve between the fresh air inlet and the spent air outlet. The valve has a variety of positions in which the flow of air through the various inlets and outlets is controlled. In some cases the differing sizes and the corresponding dwell area is utilized to split the flow from an inlet to the two outlets.

A particular aspect of the present invention relates to air flow control in a heating and/or cooling system particularly a solar collector system. In U.S. Pat. No. 3,997,108, issued to Mason on Dec. 14, 1976, there is shown an automatic air flow control system for a solar heating system. The Mason patent exemplifies the complexity involved in controlling air flow through a solar heating system, and in particular utilizes four separate adjustable dampers to direct air flow as desired. Each of the damper controls utilizes a damper member mounted within a rectangular box and pivotable about an axis located centrally of one side of the box. Passageways connect with three other sides of the box and adjustment of the damper member directs flow between a first one of these passageways and either one or the other of the remaining two passageways.

SUMMARY OF THE INVENTION

In one aspect of the present invention, there is provided a flow director utilizing a single rotatable damper to provide desired flow paths among four passageways. In a first position, flow is directed from a first passageway to a second passageway, and also is directed from a third passageway to a fourth passageway; in a second position flow is directed from the second passageway to the third passageway but is prevented between the first and fourth passageways. In a further aspect of the present invention, the flow director in combination with a solar heating system provides for the appropriate control of air circulation through the system.

It is an object of the present invention to provide a flow director which is simple and inexpensive in construction, but which provides desired flow path control in particular applications.

Another object of the present invention is to provide a flow director which is easily operated, and in particular which utilizes internal baffles to facilitate establishing the desired positions for the control apparatus.

It is a further object of the present invention to provide a flow director in combination with a heating and/or cooling system, particularly a solar collector system, for appropriate control of air circulation.

Further objects and advantages of the present invention will become apparent from the description of the preferred embodiment which follows.

DESCRIPTION OF THE PREFERRED EMBODIMENTS

Figure 1:
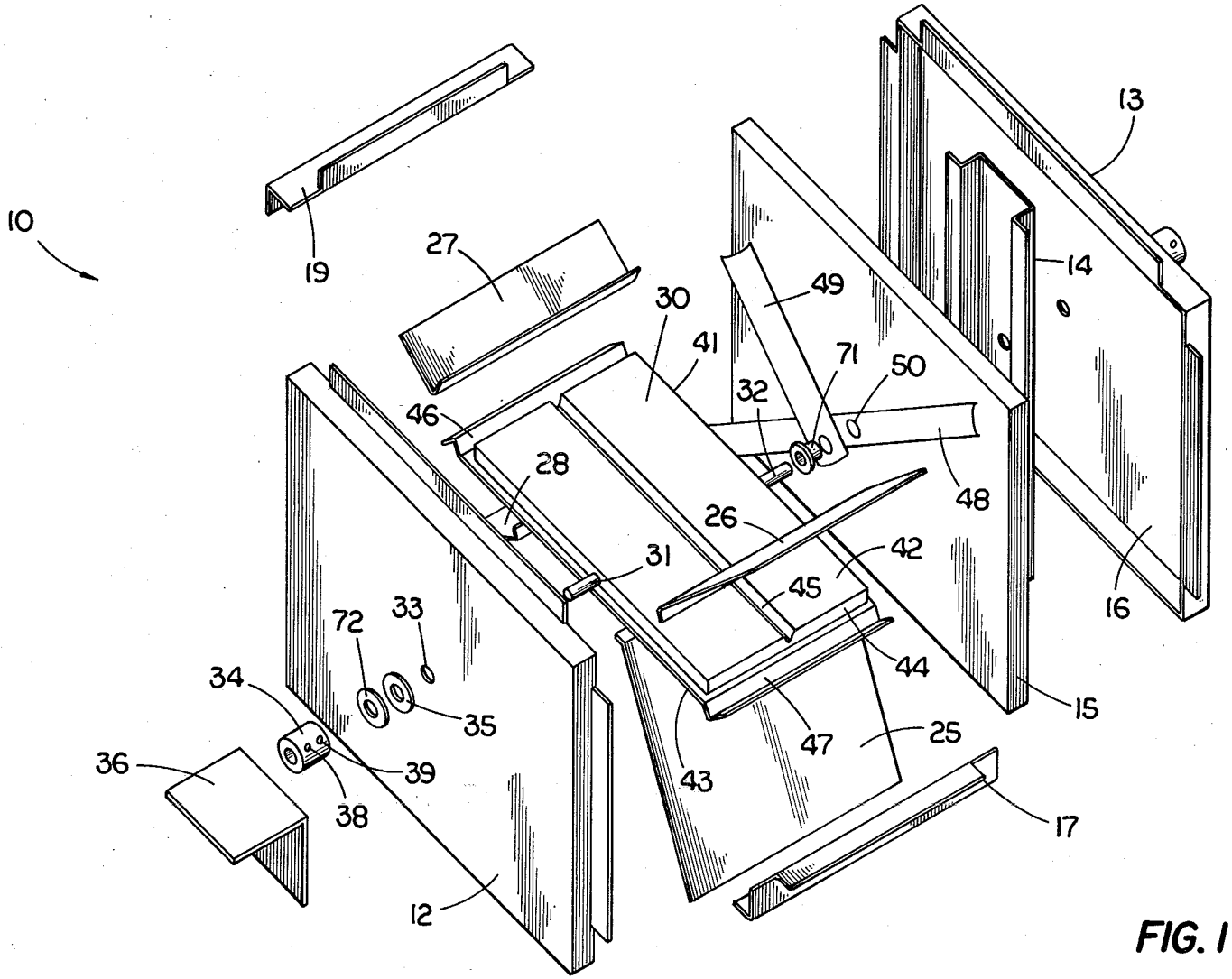
FIG. 1 is an exploded, perspective view of a diverting box constructed in accordance with the present invention.

In one aspect, the present invention provides a diverting box which utilizes internal baffles and a single rotatable damper to provide two alternatives of flow direction. The flow director is both simple in construction and reliable in operation. Complicated, expensive and/or unreliable interconnections of separate diverting boxes or separate dampers are avoided. Further, the flow director of the present invention has a particular application in use with solar heating and/or cooling systems in which two of the flow directors can replace four or more diverting boxes utilized in the prior art.

Referring in particular to the drawings, there is shown a flow director 10 constructed in accordance with the present invention. Flow director 10 comprises a diverting box 11 having opposed sides 12 and 13. Preferably, the sides are reinforced to prevent bending or warping, and such reinforcement is suitably provided by a U-shaped channel member 14 sandwiched between side members 15 and 16. Side 12 is also preferably constructed and reinforced as described with respect to side 13. Mixing box 11 also includes wall portions, such as 17–20, which define openings 21–24.

Mounted within the diverting box is a first baffle 25. First baffle 25 extends inwardly from wall portions 17 and spans between the sides 12 and 13 of the diverting box. Further mounted within the diverting box are baffles 26–28 which extend inwardly from wall portions 18–20, respectively. Each of baffles 26–28 span between the sides 12 and 13 of the diverting box, and may include angled tip portions, such as 29 (FIG. 3) as is customary in the art. Preferably each of the baffles 25–28 are sealed to the sides 12 and 13 of the diverting box 11 to avoid significant air flow or leakage therebetween.

A damper 30 is rotatably mounted within the diverting box 11. Damper 30 is rotatable about an axis extending normal to sides 12 and 13, and such rotational movement may be provided by mountings of a variety of types. Most conveniently and preferably, the damper 30 includes rod portions 31 and 32 which extend therefrom and are received within holes, such as 33. Collars, such as 34, and suitable washers such as 35 are mounted to the rod portions 31 and 32 to retain the damper 30 for rotatable movement within the holes such as 33. Nylon busihings such as 71, are preferably mounted upon portions 31 and 32 interior of the sides. Thrust bearings, such as 72, are positioned between the washers such as 35 and the collars such as 34. Baffle 25 extends inwardly to the damper 30, and preferably is sealed therewith at about the rotational axis of the damper.

It will be readily appreciated that various alternate constructions for mounting the damper rotatably within diverting box 11 could be utilized. For example, rod portions 31 and 32 could be and preferably are the end portions of a continuous rod extending through the center of damper 30. The damper could be rotatable about a rod extending therethrough which would then be fixed in position relative the diverting box. It is preferred, however, that the damper and rod portions 31 and 32 be secured to each other such that rotation of the portions provides corresponding rotation of the damper. In this manner, the rotation of the damper may be controlled by rotating the portion extending outside of the diverting box. Other customary constructions for providing controlled rotation of the damper could be utilized, but the described construction is preferred.

Figure 2:
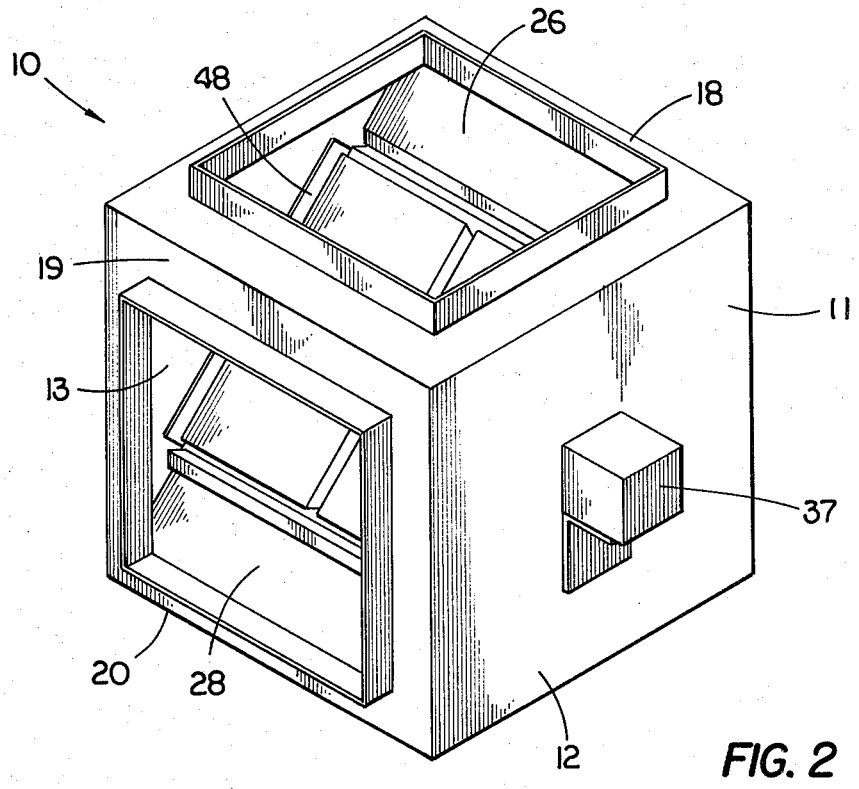
FIG. 2 is a perspective view of an assembled diverting box constructed in accordance with the present invention.

A mounting bracket 36 is preferably secured to side 12 and a motor 37 (FIG. 2) is secured thereto. The motor shaft (not shown) is received within collar 34 and is secured thereto by a set screw 38. A similar set screw 39 secures the collar 34 to the rod portion 31 extending from the diverting box. In this manner, rotation of the motor shaft by operation of the motor will provide a corresponding rotation of the damper 30. As is apparent from the description, the U-shaped braces provide structural support for the sides 12 and 13, and also the U-shaped brace in side 12 will further support the mounting of the motor by bracket 36. As will be further described, the motor, operated by a suitable power source, is utilized to move the damper between a first and second position.

By the preferred or alternate constructions, the damper 30 is rotatable about an axis positioned normal to sides 12 and 13. Damper 30 is constructed to be rigid, and includes sides 40 and 41 shaped complementary to the interior surfaces of sides 12 and 13. Preferably the damper is constructed to include a top 42 and bottom 43, with a layer of insulating material 44 sandwiched therebetween. A V-shaped portion 45, or other construction, is preferably included to provide further rigidity to the damper structure. Further, angled end portions 46 and 47 are preferably included to extend from the ends of damper 30 and to be positioned and shaped to conform with the angled tips, such as 29, of the baffles within the diverting box. Means for sealing the sides 40 and 41 of damper 30 to the interior surfaces of sides 12 and 13 are preferably included. As shown in FIG. 1, this seal may conveniently be provided by the use of spring steel closing strips, such as 48 and 49, positioned to correspond with the first and second positions of the damper 30. The strips 40 and 49 may be mounted to the interior of the diverting box by various methods, and preferably include apertures such as 50 to receive the rod portions 31 and 32 therethrough.

Figure 3:
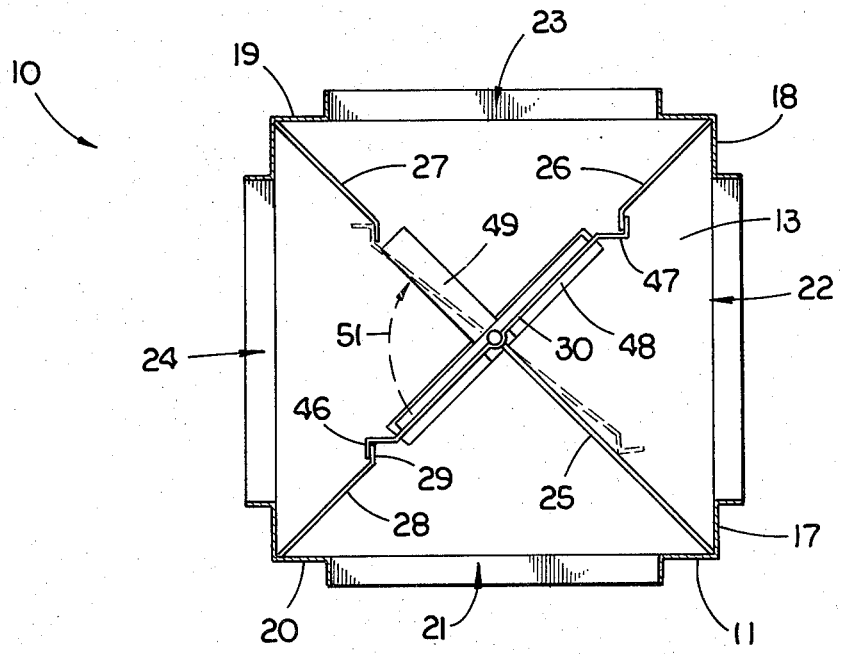
FIG. 3 is a side, cross-sectional view of a diverting box constructed in accordance with the present invention.

Referring in particular to FIG. 3, it may be readily appreciated that the damper 30 has a first position and a second position. In the first position, shown by solid lines in FIG. 3, the damper 30 includes a first portion extending from the rotational axis and positioned adjacent baffle 26. Also in the first position shown in FIG. 3, damper 30 includes a second portion extending in a differing direction than the first portion and being positioned adjacent baffle 28. Damper 30 may alternatively be rotated in the direction indicated by arrow 51 to the second position, shown in FIG. 3 by the broken line image of the damper. In the second position, one of the outwardly extending portions of damper 30 is positioned adjacent baffle 27, it being the second portion as shown in FIG. 3.

In the first position, damper 30 bridges between baffles 26 and 28, and thereby permits flow between passageways 23 and 24. At the same time, the positioning of the damper in the first position prevents flow from either of openings 23 or 24 to either of the openings 21 or 22, and further the cooperation of damper 30 with baffle 25 prevents flow between openings 21 and 22. In the second position, the damper 30 in combination with baffles 25 and 27 prevents flow from either of openings 21 or 24 to either of openings 22 or 23. At the same time, the positioning of the damper in the second position permits flow between openings 21 and 24 and further permits flow between openings 22 and 23. The tips, such as 29, of the baffles and/or the end portions 46 and 47 of damper 30 may include sealing gaskets to further seal the damper ends and adjacent baffles in the first and second positions. In many applications it is particularly advantageous that the damper engage the baffles in the first and second positions. The baffles then simply act as stops which automatically position the damper conrrectly. In other words, the damper is simply moved fully in one direction, until engaging baffles to assume one position, and fully on the opposite direction to assume the other position.

It will be appreciated that variations in the construction depicted in FIG. 3 could be made within the scope of the present invention. In the first position, the damper 30 could be adjacent the opposite sides of baffles 26 and 28, and would then rotate in a direction opposite to arrow 51 in order to move to the second position. In this instance, the portion of damper 30 resting adjacent baffle 26 in the first position would rest adjacent baffle 27 in the second position. In addition, the damper 30 is shown to have a planar form, thus having the two portions which engage the baffles extending in directly opposite directions from the rotational axis. This configuration could be modified by having the damper 30 assume a V-shaped, cross-sectional configuration with the baffles 25–28 positioned as then required. Further, as shown in FIG. 3, the first baffle 25 extends to about the center of a square diverting box 11, with baffles 26–28 extending outwardly from the corners a sufficient distance to contact the damper 30, which is also thereby permitted to be short enough to rotate without interfering with the normal side walls of the diverting box. Alternatively, the first baffle 11 could extend short of or beyond the center of the diverting box with the other interior baffles being modified in length and/or position in order to accomplish the same relationships with the damper in the first and second positions.

As another variation, the first baffle 25 could extend from a side, rather than a corner, of the diverting box with the other baffles similarly being changed in their location to generally extend from the other three sides of the box as viewed in cross section. In this configuration, the damper 30 would be parallel to the side from which the first baffle extends when in the first position, and would be generally perpendicular to that side in the second position. Although these and other variations could be utilized and are considered to fall within the present invention, the embodiment of FIG. 3 is considered to be the preferred embodiment for the invention. Further, it is generally preferable to have the baffles spaced equiradially about the rotational axis in 90° intervals. It is believed that the embodiment as shown in FIG. 3 provides for the maximum length of damper 30 and the maximum widths for the openings 21–24, and thus provides for the greatest cross-sectional area for flow to occur through the various openings. Other embodiments may, however, be desirable in certain applications.

Figure 4:
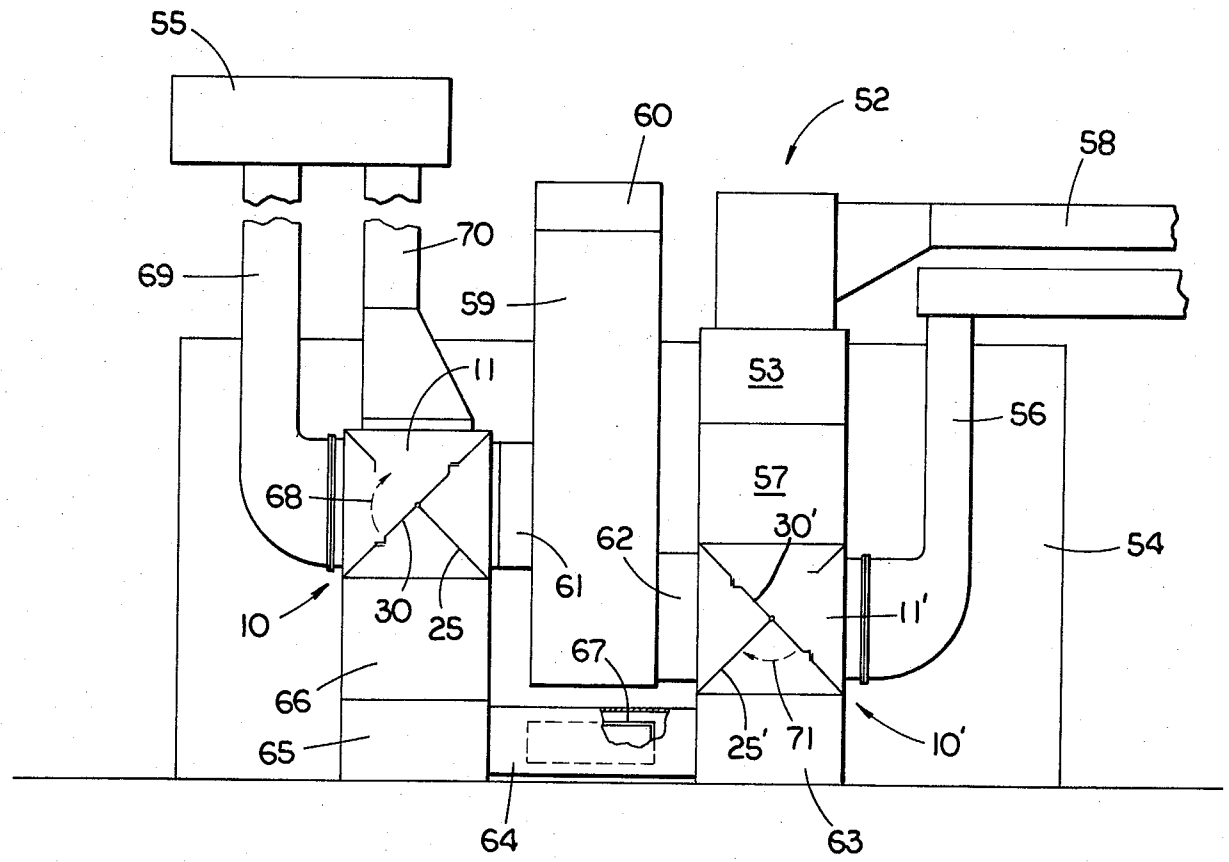
FIG. 4 is a schematic of a solar collector system utilizing diverting boxes in accordance with the present invention.

Referring in particular to FIG. 4, there is shown an air treatment system utilizing a pair of flow directors in accordance with the present invention. The flow director of the present invention is useful in a variety of such systems, but it does have a particularly advantageous application in use with a solar collector system for heating and/or cooling. The use of the flow director in conjunction with air treatment systems is therefore described in the specific example of use with a solar collector system. System 52 includes a pair of flow directors 10 and 10'. The combination of the two flow directors provides for the desired air flow among the conventional furnace 53, energy storage bin 54 and collector system 55. As will be further described, the two flow directors 10 and 10' provide for distinct flow patterns as typically required in such systems.

In a first arrangement of the flow directors, the damper 30' is in the first position, as shown in FIG. 4. In this configuration, return air is delivered to the furnace through the return air duct 56 and due to the positioning of damper 30' is passed directly to the furnace blower 57. Blower 57 forces the air through the furnace 53 where it is suitably heated and then on to the supply air duct 58. Duct 59 interconnects through duct 60 to the top of the storage bin 54, through duct 61 to flow director 10, and through duct 62 to flow director 10'. Further, plenum 63 connects to duct 64, and duct 64 connects through plenum 65 to the solar blower 66 and with duct 67 to the bottom of storage bin 54. In the first arrangement, the cooperation of damper 30' and baffle 25' prevents flow of air from the storage bin or solar collectors through duct 62 or plenum 63 to the return air stream circulated through diverting box 11' to the conventional furnace 53. In addition to preventing this direct flow, the baffle 25' further operates to prevent convectional flow of air adjacent damper 30', thus minimizing the tendency for the colder air in the solar collectors or storage bin to reduce the temperature at damper 30'. This avoids undesirable heat loss from the air passing through furnace 53 to the air on the baffled side of damper 30'.

Independent of the positioning of the damper 30' in the first position as shown in FIG. 4, damper 30 may assume either position, as desired. If the temperature in the solar collectors is below that in the storage bin, then damper 30 is preferably in the first position, as shown in FIG. 4. In this position, damper 30 prevents contact of the colder air from the solar collectors with the storage bin. Further, baffle 25 prevents convective flow of air adjacent damper 30 and thus minimizes heat transfer across the damper 30 from the warmer air in the storage bin to the colder air in the solar collectors.

Alternatively, with the damper 30' in the first position, it would be desirable to charge the storage bin if the solar collectors are at temperature greater than the temperature within the storage bin. In these circumstances, damper 30 is rotated as shown by arrows 68 to the second position. The solar blower 66 is then utilized to force air from the inlet plenum 65 to the solar collector inlet 69. The air then passes through the solar collectors 55 and through the collector outlet 70, and consecutively through the diverting box 11, duct 61, duct 59 and duct 60 to the storage bin 54. The air passes through the storage bin and out duct 67 to duct 64 and plenum 65 back to the solar blower 66. In this fashion, air is moved through the solar collectors to obtain heat and is then passed through the storage bin to effect heat transfer to the storage medium within the bin.

As previously described, the damper 30' is located in the first position to pass air from the return air duct 56 directly through furnace 53 and then to the supply air duct 58. Generally this flow is desirable in the event that the temperature in the solar collectors or in the storage bin is below the temperature of the return air, thus requiring heating to be accomplished by use of the furnace 53. The two flow directors also provide for proper air flow in the event that either the solar collector temperature or storage bin temperature is greater than the return air temperature. In the first instance, the damper 30' would be rotated in the direction of arrows 71 to permit flow from the return air duct 56 to plenum 63. If the solar collector temperature is sufficient, then damper 30 is rotated in the direction of arrows 68 and the return air passes from plenum 63 consecutively through duct 64, plenum 65, solar blower 66, diverting box 11, and solar collector inlet 69. After passing through the solar collector 55, the air will pass through the collector outlet 70 and diverting box 11 to the duct 61. From duct 61 the air will move into duct 59 and then may move either through duct 60 to the storage bin or through duct 62 to the diverting box 11'. Due to the nature of the storage bin and the resistance to air flow through the bin, the air will not significantly pass into the storage bin. Instead, the air will move into the diverting box 11' and then through the furnace blower 57 to supply air duct 58. Passage of the air along this path through the diverting box 11' is facilitated by the operation of furnace blower 57 which will draw the air directly along that route, rather than having the air pass through the storage bin as previously indicated.

Alternatively, the air may be passed through the storage bin if the temperature within the bin is sufficient. In this respect, the damper 30' is again in the second position rotated approximately 90° from the position shown in FIG. 4. Return air will then pass through the diverting box 11' to plenum 63 and then to duct 64. To move the air through the storage bin, damper 30 is placed in the first position, as shown in FIG. 4, thus preventing flow of air through the blower 66 and diverting box 11. The air will therefore travel from duct 64 through duct 67 to the storage bin bottom. The air is heated within the storage bin and passes consecutively through duct 60, duct 59, duct 62, diverting box 11', blower 57 and supply air duct 58.

Control of the dampers within the flow directors may be provided by a variety of conventional systems as well known in the prior art. Such controls may be set to position the dampers in accordance with selected priorities. Thus, in the circumstance in which the temperatures within the solar collectors and storage bin are both greater than the temperature of the return air, the dampers may be controlled to selectively pass the air through either the collectors or the storage bin as desired. Typically it is preferable to pass the air through the solar collectors to take advantage of that heat source while it is present, thus preserving the heat accessible within the storage bin.

Additionally, other controls may be utilized to operate the described system in accordance with known practices. Thus, it is readily understood that the solar collectors and/or storage bin may be insufficient to provide enough heat to the return air for heating purposes. Under those circumstances, it is customary that the furnace 53 be utilized in combination with the solar collectors and/or storage bin to raise the temperature of the supply air as desired. As will be appreciated, a variety of variations in the solar collector and storage system as described with respect to FIG. 4 may be made and are considered to fall within the scope of the present invention. It is a particular aspect of the present invention, however, that the utilization of one or more of the flow directors as described in accordance with the present invention will provide a simple, inexpensive and reliable means for providing proper air flow through the system. Thus, although the system components may change in other respects, the combination of the system components with the flow directors, particularly as depicted in FIG. 4, is a particular aspect and advantage of the present invention.

What is claimed:

1. The combination comprising:

a furnace including a blower for moving air therethrough from an inlet to an outlet;

a diverting box having at least first and second opposed sides, said diverting box including wall portions defining first, second, third and fourth openings arranged consecutively between the first and second sides;

a first baffle mounted within said diverting box and extending inwardly from a wall portion between the first and second openings, said first baffle spanning between the first and second opposed sides of said diverting box;

second, third and fourth baffles mounted within said diverting box and extending inwardly from wall portions between the second and third, third and fourth, and fourth and first openings, respectively, each of said baffles spanning between the first and second opposed sides of said diverting box;

a damper rotatably mounted within said diverting box, said damper being rotatable about an axis extending normal to the first and second opposed sides, said first baffle extending inwardly to said damper, said damper having first and second portions extending in differing directions from said axis, said damper having a first position in which the first and second portions are adjacent said second and fourth baffles respectively, thereby permitting flow between the third and fourth openings and blocking flow between the first and second openings, said damper further having a second position in which one of the first and second portions of said damper is adjacent said third baffle, thereby permitting flow between the first and fourth openings and between the second and third openings;

said diverting box being connected to said furnace with the inlet of said furnace communicating with the third opening of said diverting box;

a supply air duct connected to said furnace with the outlet of said furnace communicating with said supply air duct;

a return air duct connected to said diverting box with said return air duct communicating with the fourth opening of said diverting box;

means for treating air, said air treating means including an inlet and an outlet;

first connecting means for connecting the first opening of said diverting box with the inlet of said air treating means; and second connecting means for connecting the second opening of said diverting box with the outlet of said air treating means.

2. The combination of claim 1 in which said air treating means includes a solar collector system having an inlet and an outlet, said combination further comprising:

a second diverting box having at least first and second opposed sides, said second diverting box including wall portions defining first, second, third and fourth openings arranged consecutively between the first and second sides;

a first baffle mounted within said second diverting box and extending inwardly from a wall portion between the first and second openings, said first baffle spanning between the first and second opposed sides of said second diverting box;

second, third and fourth baffles mounted within said second diverting box and extending inwardly from wall portions between the second and third, third and fourth, and fourth and first openings, respectively, each of said baffles spanning between the first and second opposed sides of said second diverting box;

a damper rotatably mounted within said second diverting box, said damper being rotatable about an axis extending normal to the first and second opposed sides, said first baffle extending inwardly to said damper, said damper having first and second portions extending in differing directions from said axis, said damper having a first position in which the first and second portions are adjacent said second and fourth baffles respectively, thereby permitting flow between the third and fourth openings and blocking flow between the first and second openings, said damper further having a second position in which one of the first and second portions of said damper is adjacent said third baffle, thereby permitting flow between the first and fourth openings and between the second and third openings, said first connecting means connecting said first diverting box to said second diverting box with the first opening of said first diverting box communicating with the first opening of said second diverting box;

third connecting means for connecting said second diverting box to the solar collector system with the fourth opening of said second diverting box communicating with the inlet of the solar collector system;

fourth connecting means for connecting the solar collector system with said second diverting box with the outlet of the solar collector system communicating with the third opening of said second diverting box;

storage means for storing energy obtained by the solar collector system, said storage means including an inlet and an outlet; and fifth connecting means for connecting said second diverting box to said storage means with the second opening of said second diverting box communicating with the inlet of said storage means, said second connecting means connecting said storage means to said first diverting box with the outlet of said storage means communicating with the second opening of said first diverting box.

* * * * *